US010381208B2

(12) United States Patent
Smirnov et al.

(10) Patent No.: US 10,381,208 B2
(45) Date of Patent: Aug. 13, 2019

(54) METHOD OF PROCESSING AN IMAGE CHARGE/CURRENT SIGNAL

(71) Applicant: SHIMADZU CORPORATION, Kyoto-shi, Kyoto (JP)

(72) Inventors: Sergey Smirnov, Manchester (GB); Li Ding, Manchester (GB); Aleksandr Rusinov, Manchester (GB)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/072,550

(22) PCT Filed: Mar. 22, 2017

(86) PCT No.: PCT/EP2017/056887

§ 371 (c)(1),
(2) Date: Jul. 25, 2018

(87) PCT Pub. No.: WO2017/162779

PCT Pub. Date: Sep. 28, 2017

(65) Prior Publication Data

US 2019/0035615 A1 Jan. 31, 2019

(30) Foreign Application Priority Data

Mar. 24, 2016 (GB) ..... 1605084.1
Feb. 14, 2017 (WO) ..... PCT/EP2017/053297

(51) Int. Cl.
*H01J 49/00* (2006.01)
*H01J 49/42* (2006.01)
*H01J 49/02* (2006.01)

(52) U.S. Cl.
CPC ..... *H01J 49/0036* (2013.01); *H01J 49/0004* (2013.01); *H01J 49/0009* (2013.01); *H01J 49/027* (2013.01); *H01J 49/4245* (2013.01)

(58) Field of Classification Search
CPC ..... H01J 49/0004; H01J 49/0009; H01J 49/0027; H01J 49/0031; H01J 49/0036; H01J 49/027; H01J 49/38; H01J 49/4245
See application file for complete search history.

(56) References Cited

U.S. PATENT DOCUMENTS 8,362,418 B2 * 1/2013 Xu ..... H01J 49/426 250/281
8,890,060 B2 * 11/2014 Ding ..... H01J 49/0036 250/281

(Continued)

FOREIGN PATENT DOCUMENTS

EP 2642508 A2 9/2013

OTHER PUBLICATIONS

Sun et al, "Quantitative Mass Spectrometry by Orthogonal Projection Method with Periodic Signal of Electrostatic Beam Ion Trap", International Journal of Mass Spectrometry 300, 2011, p. 59-64 (Year: 2011).*

(Continued)

*Primary Examiner* — David E Smith
(74) *Attorney, Agent, or Firm* — Sughrue Mion, PLLC

(57) ABSTRACT

A method of processing an image charge/current signal representative of trapped ions undergoing oscillatory motion. The method includes: identifying a plurality of fundamental frequencies potentially present in the image charge/current signal based on an analysis of peaks in a frequency spectrum corresponding to the image charge/current signal in the frequency domain, wherein each candidate fundamental frequency falls in a frequency range of interest; deriving a basis signal for each candidate fundamental frequency using a calibration signal; and estimating relative abundances of ions corresponding to the candidate fundamental frequencies by mapping the basis signals to the image charge/current signal. At least one candidate fundamental frequency is calculated using a frequency associated with a peak that falls outside the frequency range of interest and that has been determined as representing a second or higher order harmonic of the candidate fundamental frequency.

20 Claims, 10 Drawing Sheets

(56) References Cited

U.S. PATENT DOCUMENTS

| | | | | |
|---|---|---|---|---|
| 2009/0084949 | A1 | 4/2009 | Franzen et al. | |
| 2011/0240845 | A1 | 10/2011 | Ding | |
| 2013/0311110 | A1* | 11/2013 | Aizikov ..... | H01J 49/0036 702/32 |

OTHER PUBLICATIONS

International Search Report, dated May 30, 2017 from the International Bureau in counterpart International application No. PCT/EP2017/053297.

Sun, Q., et al., "Multi-ion quantitative mass spectrometry by orthogonal projection method with periodic signal of electrostatic ion beam trap", Journal of Mass Spectrometry, vol. 46, No. 4, 2011, 4 pages, XP055232000.

Communication dated Aug. 22, 2016 from the Intellectual Property Office of Great Britain in counterpart application No. 1605084.1.

International Search Report, dated May 29, 2017 from the International Bureau in counterpart International application No. PCT/EP2017/056887.

Greenwood, J.B., et al., "A comb-sampling method for enhanced mass analysis in linear electrostatic ion traps", Review of Scientific Instruments, American Institute of Physics, vol. 82, No. 4, 2011, 6 pages, XP012146326.

Sun, Q., et al., "Quantitative mass spectrometry by orthogonal projection method with periodic signal of electrostatic ion beam trap", International Journal of Mass Spectrometry, vol. 300, 2011, pp. 59-64.

* cited by examiner

| Detected Peaks | Harmonics | |
|---|---|---|
| kHz | *before validation* | *after validation* |
| 400 | 2, ..., 1 | 1 |
| 500 | 2, ..., 1 | 1 |
| 600 | 3, ..., 1 | 1 |
| 800 | 4, ..., 1 | 2,1 |
| 1,000 | 5, ..., 1 | 2,1 |
| 1,200 | 6, ..., 2 | 3,2 |
| 1,500 | 7, ..., 2 | |
| 1,600 | 8, ..., 2 | 4,2 |
| 1,800 | 9, ..., 2 | 3 |
| 1,900 | 9, ..., 2 | |
| 2,000 | 10, ..., 2 | 5,4,2 |

Figure 3

```
100 ions of mass 200.00 Da
 10 ions of mass 355.56 Da
 10 ions of mass 357.00 Da
 40 ions of mass 357.00 Da
 16 ions of mass 609.00 Da
  4 ions of mass 609.10 Da
 20 ions of mass 800.00 Da
```

Figure 5

199.999750218713 Da
355.559775011924 Da
356.9997404704 Da
357.099868949803 Da
608.999884994741 Da
609.099608246023 Da
799.999872477427 Da

Figure 8

| TRUE | | DETECTED | |
|---|---|---|---|
| *Mass* | *Intensity* | *Mass* | *Intensity* |
| 200.000 | 100 | 200.000 | 100 |
| 355.560 | 10 | 355.560 | 10 |
| 357.000 | 10 | 357.000 | 10 |
| 357.100 | 40 | 357.100 | 40 |
| 609.000 | 16 | 609.000 | 16 |
| 609.100 | 4 | 609.100 | 4 |
| 800.000 | 20 | 800.000 | 20 |

Figure 9

METHOD OF PROCESSING AN IMAGE CHARGE/CURRENT SIGNAL

CROSS REFERENCE TO RELATED APPLICATIONS

This application is a National Stage of International Application No. PCT/EP2017/056887 filed Mar. 22, 2017, claiming priority based on British Patent Application No. 1605084.1 filed Mar. 24, 2016 and International Application No. PCT/EP2017/053297 filed Feb. 14, 2017.

FIELD OF THE INVENTION

This invention relates to a method of processing an image charge/current signal representative of trapped ions undergoing oscillatory motion.

BACKGROUND

In general, an ion trap mass spectrometer works by trapping ions such that the trapped ions undergo oscillatory motion, e.g. backwards and forwards along a linear path or in looped orbits.

An ion trap mass spectrometer may produce a magnetic field, an electrodynamic field or an electrostatic field, or combination of such fields to trap ions. If ions are trapped using an electrostatic field, the ion trap mass spectrometer is commonly referred to as an "electrostatic" ion trap mass spectrometer.

For the avoidance of any doubt, in this disclosure the terms "mass" and "mass/charge ratio" may be used interchangeably. The term "ion" may be used to refer to an ion or any other charged particle.

In general, the frequency of oscillation of trapped ions in an ion trap mass spectrometer is dependent on mass/charge ratio of the ions, since ions with large mass/charge ratios generally take longer to perform an oscillation compared with ions with small mass/charge ratios. Using an image charge/current detector, it is possible to obtain, non-destructively, an image charge/current signal representative of trapped ions undergoing oscillatory motion in the time domain. This image charge/current signal can be converted to the frequency domain e.g. using a Fourier transform ("FT"). Since the frequency of oscillation of trapped ions is dependent on mass/charge ratio, an image charge/current signal in the frequency domain can be viewed as mass spectrum data providing information regarding the mass/charge ratio distribution of the ions that have been trapped.

The inventors have observed that an image charge/current signal obtained using an ion trap mass spectrometer is often not perfectly harmonic. In other words, an image charge/current signal obtained using an ion trap mass spectrometer often has a non-harmonic waveform (e.g. having the form of sharp pulses) in the time domain, which can result in the image charge/current signal having a plurality of harmonics in the frequency domain.

When an image charge/current signal representative of trapped ions having different mass/charge ratios undergoing oscillatory motion in the time domain is converted into a frequency spectrum corresponding to the charge/current signal in the frequency domain, e.g. using a Fourier transform, the image charge/current signal can be represented as a series of peaks in the frequency spectrum, where for trapped ions that have a single mass/charge ratio there is a corresponding set of peaks. A peak in the set has a fundamental frequency corresponding to that mass/charge ratio, and each of the remaining peaks in the set have a respective frequency that is a (second or higher order) harmonic of that fundamental frequency. If the trap contains a plurality of ions with different mass/charge ratios, each mass/charge ratio may be represented by a respective set of peaks in the frequency spectrum and peaks from different sets (i.e. corresponding to different mass/charge ratios) may overlap. Overlapping harmonic peaks in the frequency spectrum can make it difficult to obtain useful information regarding the mass/charge ratio distribution of trapped ions without limiting the range of mass/charge ratios of ions used to obtain the image charge/current signal. Further understanding of these issues can be found in Reference [2] (with particular reference to FIG. 1 of this document).

Methods that attempt to address these difficulties are set out in References [1]-[3] as set out in the References section, below.

All of References [1]-[3] deal with the processing of a complex signal composed of a combination of image current signals each of which is produced by a certain number of ions of the same mass/charge ratio moving in an electrostatic ion trap (EIT) mass analyser. The aim of the processing is to determine the mass/charge ratios of those ions and their relative abundance. Below are very brief descriptions of the main ideas behind these methods.

Reference [1]: This article describes an Orthogonal Projection Method ("OPM"). Conceptually the OPM is concerned with finding the 'best fit' approximation of a test signal with a linear combination of a predetermined set of the so-called basis signals. The basis signals are not necessarily orthogonal to each other, which means their scalar products are not 0. According to this method, image current signals of ions with certain mass numbers are adopted as the basis signals that could be viewed as a set of basis vectors $\{x_1, x_2, \ldots, x_m\}$ in some vector space V. The image current signal of the test ions, v, could be orthogonally projected onto these basis vectors. This orthogonal projection, $v_0$, is the 'best-fit' approximation of the signal v in the vector space V. $v_0$ could be uniquely expressed by a linear combination of the basis vectors as $v_0=\Sigma_{j=1}^{m}\alpha_j*x_j$. In this method the mass numbers of ions corresponding to the basis vectors $x_j$ are closely and evenly spaced across a mass range of interest, so the coefficients $\alpha_j$ could indicate the amount (relative abundance) of the tested ions.

Reference [2]: This document discloses a method in which a linear combination of N image current signals, N≥2, obtained from N image charge/current detectors is used to eliminate N−1 harmonics in a complex multi-harmonic Fourier spectrum. The coefficients of the linear combination are calculated using N calibration image current/charge signals produced by ions of a known mass/charge ratio. Fourier spectra of single mass/charge ratio signals contain only one fundamental frequency and the identification of its harmonics is straightforward. With N independent Fourier spectra of the N image current signals (typically obtained from N image charge/current detectors) it is easy to find their linear combination where only one of the N harmonics is non-zero while the other N−1 harmonics are zero. The coefficients of this linear combination are determined by the instrument's geometry and therefore can be used to create a similar linear combination of other test image current signals acquired by the same instrument. When the test image current signals obtained from different pickup detectors (or their Fourier spectra) are multiplied by the corresponding coefficients and then added together the Fourier spectrum of the resulting signal will not contain N−1 of its harmonics. For example, with only two pickup detectors it is possible to eliminate only one harmonic. If we aim at eliminating the second harmonic leaving the first (the fundamental frequency) then all of the peaks in Fourier spectra with frequencies ranging from the minimal mass fundamental frequency up to the third harmonic of this frequency will be only first harmonics. This allows one to quickly detect all of the ion mass/charge ratios corresponding to this frequency range.

Reference [3]: In this article, a method is proposed for the frequency analysis of data acquired from an EIT analyser. By using comb functions with different time offsets to sample raw image current signals obtained from several different pickup detectors, and by comparing with the standard Fourier transform, a spectrum containing only fundamental frequencies could be obtained.

The image current from an EIT analyser is not perfectly harmonic and the Fast Fourier Transform technique of such a signal generates a set of harmonics for each single mass/charge ratio. Multiple harmonics make it very difficult to obtain the true mass spectrum when many different masses of ions are compounded together. The problem to be solved here is not only to discover the masses of different ion species in a spectrum, but also to find their intensities.

Previously developed peak detection methods for an EIT analyser (see e.g. References [1]-[3]) had a number of disadvantages, such as lower mass range and lower resolving power; none of the methods allowed reasonably accurate calculations of ion abundancies. Some of those disadvantages could be mitigated by utilizing more sophisticated (and therefore more expensive) modifications of the EIT analyser's hardware. However, even then the methods produced results that concealed one or more of the performance characteristics of the EIT analyser.

The present invention has been devised in light of the above considerations.

SUMMARY OF THE INVENTION

In a general aspect, the present invention relates to a method of processing an image charge/current signal representative of trapped ions undergoing oscillatory motion, the method including:

- identifying a plurality of candidate fundamental frequencies potentially present in the image charge/current signal based on an analysis of peaks in a frequency spectrum corresponding to the image charge/current signal in the frequency domain, wherein each candidate fundamental frequency falls in a frequency range of interest;
- deriving a basis signal for each candidate fundamental frequency using a calibration signal; and
- estimating relative abundances of ions corresponding to the candidate fundamental frequencies by mapping the basis signals to the image charge/current signal.

As is known in the art, an image charge/current signal representative of trapped ions undergoing oscillatory motion is a periodic signal in the time domain and may therefore be represented as a sum of periodic signals (e.g. a sum of sinusoidal signals, e.g. using a Fourier transform), where for trapped ions that have a single mass/charge ratio there is a corresponding set of periodic signals, wherein a periodic signal in the set has a fundamental frequency corresponding to that mass/charge ratio, and each of the remaining periodic signals in the set has a frequency that is a respective (second or higher order) harmonic of that fundamental frequency.

A harmonic of a fundamental frequency may be defined as a positive integer multiple of the fundamental frequency. An "Nth order harmonic" of a fundamental frequency may therefore refer to a harmonic having a frequency that is N times the fundamental frequency, where N is a positive integer. Note that a "first harmonic" of a fundamental frequency therefore simply refers to the fundamental frequency itself.

A fundamental frequency present in an image charge/current signal may therefore be understood as the lowest frequency in a set of frequencies (called harmonics, see above) present in the image charge/current signal, wherein the set of frequencies corresponds to trapped ions undergoing oscillatory motion that have a single mass/charge ratio.

For avoidance of any doubt, oscillatory motion may include ions oscillating along a linear path (e.g. backwards and forwards along a linear path in a linear ion trap) or along a curved path (e.g. in looped orbits in a cyclotron).

Reference [1] describes an orthogonal projection method in which basis signals (referred to as a set of "basis vectors") are derived using a simulated calibration signal, and are further used to estimate the relative abundances of trapped ions.

Mapping the basis signals to the image charge/current signal preferably includes approximating the image charge/current signal using a linear combination of the basis signals (e.g. to provide a "best fit" of the image charge/current signal). This mapping process may be referred to herein as using an "orthogonal projection method" (or "OPM").

Estimating relative abundances of ions corresponding to the candidate fundamental frequencies by mapping the basis signals to the image charge/current signal may include finding an approximation (e.g. a 'best fit' approximation) of the image charge/current signal (in the time or frequency domain) using a linear combination of the basis signals (e.g. wherein the linear combination has been approximated, as described above). In this case, a coefficient corresponding to each basis signal in the linear combination may provide an estimate of the relative abundance of ions corresponding to the candidate fundamental frequency for which the basis signal has been derived. Thus, estimating relative abundances of ions corresponding to the candidate fundamental frequencies by mapping the basis signals to the image charge/current signal may include using an orthogonal projection method, e.g. based on the principles described in Reference [1].

Conventional methods of processing an image charge/current signal representative of trapped ions undergoing oscillatory motion typically involve producing a mass spectrum of the trapped ions by performing a Fourier transform ("FT") on the image charge/current signal. The resulting mass spectrum (derived from the Fourier transform of the image charge/current signal) can however be highly complex as it may include many peaks caused by second and higher order harmonics, thus making it difficult to interpret the mass spectrum. It is therefore difficult to estimate the relative abundances of the trapped ions using these conventional methods.

An advantage of estimating relative abundances of ions corresponding to the candidate fundamental frequencies by mapping the basis signals to the image charge/current signal is that the relative abundances can be estimated in a manner that need not be disrupted by the presence of peaks relating to second and higher order harmonics. This is because the relative abundances can be estimated based on the mapping of the basis signals to the image charge/current signal (e.g. as described above), rather than reading off peaks directly from a Fourier transform (where it may be difficult to distinguish peaks relating to second or higher order harmonics from peaks relating to fundamental frequencies).

In this document, the term "candidate" is used in connection with the candidate fundamental frequencies because even if it is inferred from an analysis of peaks in the frequency spectrum that a candidate fundamental frequency that falls in a frequency range of interest is potentially present in the image charge/current signal, it is still possible that the candidate fundamental frequency does not represent an actual fundamental frequency in the image charge/current signal (e.g. because the peaks that indicated the presence of the candidate fundamental frequency may actually be caused by a harmonic of a different fundamental frequency which is lower than the candidate fundamental frequency). Thus, it might only become apparent that a candidate fundamental frequency does not represent an actual fundamental frequency in the image charge/current signal, if the estimated relative abundance of ions corresponding to that candidate fundamental frequency (obtained by mapping the basis signals to the image charge/current signal) is zero or close to zero.

For the avoidance of any doubt, the frequency spectrum corresponding to the image charge/current signal may include peaks in the frequency range of interest that are not associated with an identified candidate fundamental frequency. For example, such peaks might be caused by noise, or have an intensity that is deemed too small to be significant.

Preferably, the relative abundances of ions corresponding to the candidate fundamental frequencies are estimated by mapping the basis signals to the image charge/current signal in the time domain.

Preferably, a first aspect of the invention provides a method of processing an image charge/current signal representative of trapped ions undergoing oscillatory motion, the method including:

identifying a plurality of candidate fundamental frequencies potentially present in the image charge/current signal based on an analysis of peaks in a frequency spectrum corresponding to the image charge/current signal in the frequency domain, wherein each candidate fundamental frequency falls in a frequency range of interest;

deriving a basis signal for each candidate fundamental frequency using a calibration signal; and estimating relative abundances of ions corresponding to the candidate fundamental frequencies by mapping the basis signals to the image charge/current signal;

wherein, at least one (preferably each) candidate fundamental frequency is calculated using a frequency associated with a peak that falls outside the frequency range of interest and that has been determined as representing a second or higher order harmonic of the candidate fundamental frequency.

By calculating a candidate fundamental frequency using a frequency associated with a peak that falls outside the frequency range of interest and that has been determined as representing a second or higher order harmonic of the candidate fundamental frequency, a much more accurate estimate of the candidate fundamental frequency can be obtained than would be the case were the candidate fundamental frequency simply read off the peak corresponding to the fundamental frequency in the signal's frequency spectrum.

This means, for example, that it is unnecessary to use basis signals derived from an array of closely and evenly spaced frequencies centred on the suspected fundamental frequency to estimate the relative abundances of ions corresponding to the candidate fundamental frequencies (as in Reference [1], see below).

Here it should be noted that in conventional methods of processing an image charge/current signal representative of trapped ions undergoing oscillatory motion, it is generally considered to be a disadvantage if the signal's frequency spectrum contains many peaks caused by second and higher order harmonics, as this can render the signal much more difficult to interpret. In contrast, the method according to the first aspect of the invention is able to advantageously use peaks caused by second and higher order harmonics to provide more accurate estimates of the candidate fundamental frequencies.

In other words, the inventors have observed that having peaks in the signal's frequency spectrum that represent second or higher order harmonics of candidate fundamental frequencies can be advantageous, using a method according to the first aspect of the invention.

The inventors believe that a method according to the first aspect of the present invention provides a data processing method that doesn't necessitate any hardware modifications to an EIT analyser (e.g. the additional detectors and the associated electronics as proposed in Reference [2]) and that may help to deliver better resolving power and resolving power within a mass range of interest and allow reasonably accurate calculations of ion abundances.

The present inventors believe that the methods described in References [1]-[3] do not deliver the same quality of results as a method according to the present invention.

For the avoidance of any doubt, the peaks which are used in the analysis to identify the plurality of candidate fundamental frequencies may fall within and/or outside (e.g. above) the frequency range of interest.

Preferably, four or less basis signals are derived for each candidate fundamental frequency.

Preferably, only one basis signal is derived for each candidate fundamental frequency.

Advantages of having four or less basis signals (preferably only one basis signal) derived per candidate fundamental frequency include improved estimates of relative abundances, and may also help to reduce the computing time required to map the basis signals to the image/charge current signal since a small number of basis signals are used.

In contrast, the orthogonal projection method as specifically described in the article of Reference [1] assumes that a suspected fundamental frequency cannot be known to a reasonable degree of accuracy, and therefore proposes a method in which a large number of basis signals are used per suspected fundamental frequency, with those basis signals being derived based on an array of closely and evenly spaced frequencies centred on the suspected fundamental frequency (see e.g. the example in which a mass detecting range is set to be 180.073±0.16 with a mass detecting interval of 0.002, requiring 161 basis signals for just the peak identified as occurring at mass number 180.073). This means that considerable computing power is required to map the basis signals to the image charge/current signal. Additionally, the array of basis signals can have significant adverse effects on the accuracy of the results if none of the evenly spaced basis signals coincides with the suspected fundamental frequency.

Preferably, the analysis of peaks in the frequency spectrum (on which the identification of candidate fundamental frequencies is based) includes a validation procedure applied to each of multiple test peaks that fall in a validation frequency range that includes frequencies that are higher than an upper bound $F_{MAX}$ of the frequency range of interest, wherein the validation procedure that is applied to each of the multiple test peaks includes:

(i) determining whether the test peak potentially represents an Nth order harmonic of a fundamental frequency $f_t/N$ falling within the frequency range of interest, where $f_t$ is a frequency associated with the test peak and N is an integer greater than 1, this determination being based on a check of whether the frequency spectrum contains, for at least one value of P (preferably each possible value of P) from P=1 to P=N−1 where P is an integer, a peak corresponding to a Pth order harmonic of the fundamental frequency $f_t/N$;

(ii) if it is determined that the test peak potentially represents an Nth order harmonic of a fundamental frequency $f_t/N$ falling within the frequency range of interest, then identifying a candidate fundamental frequency in the image charge/current signal of $f_t/N$.

Preferably, steps (i) and (ii) are performed for each possible value of N for which $f_t/N$ falls within the frequency range of interest and for which N is less than or equal to M, where M represents a predetermined maximum harmonic number.

Note that for some values of N, $f_t/N$ may fall outside the frequency range of interest, as discussed in relation to the example shown in FIG. 3.

The predetermined maximum harmonic number M may, for example, represent the order of harmonics in the image charge/current signal for which peaks are deemed to be distinguishable above a noise level in the image charge/current signal.

Checking whether the frequency spectrum contains a peak corresponding to a Pth order harmonic of a fundamental frequency $f_t/N$ may include checking whether the frequency spectrum includes a peak at a frequency of $P \times f_t/N$.

Determination of whether the spectrum contains a peak at a certain frequency may include, for example, determining whether the intensity of the spectrum exceeds a noise level in the image charge/current signal, or exceeds some other level established based on the height of previously detected harmonics/peaks.

Preferably, the validation frequency range includes frequencies between $F_{MAX}$ and $F_{MAX} \times M$, where M represents a predetermined maximum harmonic number. The validation frequency range can optionally include frequencies in the frequency range of interest.

Preferably, the validation procedure is applied to the multiple test peaks that fall in the validation frequency range starting with the peak that has a corresponding frequency closest to and less than or equal to $F_{MAX} \times M$ and continuing with the others of the multiple test peaks in decreasing order of their associated frequencies.

Preferably, the multiple test peaks include all peaks that fall in the validation frequency range. This is because even if an Mth order harmonic has been identified for each observed peak in the frequency range of interest, it is possible that not all candidate fundamental frequencies in the image charge/current signal have been identified. For example, an observed peak in the frequency range of interest may in fact result from multiple peaks corresponding to multiple closely spaced frequencies which have merged together into a single peak due to low frequency resolution in the frequency range of interest. In such a case, it may be necessary to apply the validation procedure to all peaks that fall in the validation frequency range, to ensure that all candidate fundamental frequencies are identified.

However, it should be noted that the multiple test peaks need not include all peaks that fall in the validation frequency range in all embodiments. For example, if candidate fundamental frequencies corresponding to each peak in the frequency range of interest have been identified based on test peaks determined as representing the Mth harmonic, there may be some cases in which it is not necessary to apply the validation procedure to additional peaks in the validation frequency range In practice the frequency range of interest may be chosen based on the range of ion mass/charge ratios of the ions which are undergoing oscillatory motion.

Preferably, at least one (preferably each) candidate fundamental frequency is calculated using a frequency associated with a peak in the validation frequency range that has been determined as representing the highest available order harmonic of the candidate fundamental frequency. This could be a peak determined as representing the Mth order harmonic, where M represents a predetermined maximum harmonic number, but note that if such a peak were obscured (e.g. by noise), then the highest available order harmonic of the candidate fundamental frequency might be a M−1th (or even lower) order harmonic.

Using the frequency associated with the peak in the validation frequency range that has been determined as representing the highest available order harmonic of the candidate fundamental frequency to calculate the candidate fundamental frequency can help to obtain a better estimate of the candidate fundamental frequency than can be achieved using frequencies associated with lower order harmonics.

This is because each peak in the frequency spectrum corresponding to the image charge/current signal in the frequency domain will in general have a finite width $\Delta f$, leading to an uncertainty in a frequency $f_t$ associated with a test peak. In a typical frequency spectrum, $\Delta f$ is usually similar for all peaks in the spectrum. Due to $\Delta f$, a fundamental frequency $f_t/N$ as obtained from the frequency of an Nth order harmonic will have an associated uncertainty of $\pm\Delta f/N$. Hence the larger the value of N, the smaller the uncertainty associated with the fundamental frequency. The smallest uncertainty associated with the fundamental frequency is therefore obtained for N=M, where M represents a predetermined maximum harmonic number.

Preferably, the image charge/current signal has a duration in the time domain of at least 200 ms.

The image charge/current signal may be acquired in the time domain (i.e. as a function of time) and converted into the frequency spectrum corresponding to the image charge/current signal in the frequency domain. For example a Fourier transform ("FT"), such as a fast Fourier transform ("FFT"), may be used to convert an image charge/current signal in the time domain to a frequency spectrum corresponding to the charge/current signal in the frequency domain. The use of other types of transform is also envisaged.

The frequency spectrum corresponding to the image charge/current signal in the frequency domain (whose peaks are analysed to identify a plurality of candidate fundamental frequencies) may be an absorption mode frequency spectrum. As described in more detail below, an absorption mode spectrum usually give better resolving power.

An absorption mode spectrum can be defined as the real part of an image charge/current signal in the frequency domain whose complex values have been phase corrected. The image charge/current signal in the frequency domain may be obtained by Fourier transformation of the image charge/current signal in the time domain, which typically results in an image charge/current signal in the frequency domain that has complex values (phase and amplitude information). If these complex values are phase corrected, e.g. using a pre-determined relationship between phase and mass/frequency, then the real part of the phase corrected frequency spectrum (i.e. absorption mode spectrum) will usually give better resolving power. In most cases, a pre-determined relationship between phase and mass/frequency for each harmonic can be obtained using calibration samples.

Methods for obtaining an absorption mode spectrum are known, see e.g. References [5] and [6].

Acquiring an image charge/current signal may include:

producing ions;

trapping the ions such that the trapped ions undergo oscillatory motion; and acquiring an image charge/current signal representative of the trapped ions undergoing oscillatory motion, e.g. using an image charge/current detector.

An image charge/current signal in the time domain may be padded with zeros and/or have a window function applied to it prior to converting the image charge/current signal into the frequency spectrum.

Preferably, a calibration signal is a real image charge/current signal acquired from an image charge/current signal detector for a known ion mass/charge ratio. This differs from the technique disclosed in Reference [1], where basis signals were derived from a simulation.

Using a real image charge/current signal acquired from an image charge/current signal detector is advantageous since it will contain signal features such as a non-linear dependence of phase delay on frequency (ion mass/charge ratio), and decay in the time domain.

Preferably, deriving a basis signal for a fundamental frequency using a calibration signal involves phase shifting and/or stretching the calibration signal in the time domain based on the fundamental frequency, e.g. as described below with reference to Equation (1).

Multiple calibration signals may be used to derive the basis signals. The multiple calibration signals used to derive the basis signals may be image charge/current signals obtained for known ion mass/charge ratios. Using multiple calibration signals to derive the basis signals may increase the accuracy of the basis signals.

For avoidance of any doubt, "deriving a basis signal for each candidate fundamental frequency using a calibration signal" includes the possibility of more than one calibration signal being used to derive the basis signal for each candidate fundamental frequency.

In other embodiments, a single calibration signal may be used to derive all of the basis signals.

The derivation of a basis signal for each candidate fundamental frequency may account for ions having differing masses reaching an image charge/current detector at different times after injection into an ion trap mass spectrometer. In examples discussed below, this is achieved using a time offset term $\tau$ which is dependent on mass/charge ratio.

For example, the basis signal for each candidate fundamental frequency may be derived using a time domain calibration signal, wherein the time domain calibration signal is transformed into a time domain basis signal using a time offset term which is dependent on mass/charge ratio associated with the candidate fundamental frequency. The time offset term dependent on mass/charge ratio may be derived experimentally, e.g. using a plurality of time domain calibration signals, e.g. using phase information obtained from a plurality of time domain calibration signals that have been transformed into the frequency domain (e.g. using a Fourier transform). The time offset term dependent on mass/charge ratio may also be obtained theoretically, e.g. using simulation data.

The derivation of a basis signal for each candidate fundamental may account for any time delay between the start of recording the image charge/current signal and the moment of injection of ions into an ion trap mass spectrometer. In examples discussed below, this is achieved using a time delay term $\Delta t$ (which may be zero if there is no time delay).

For example, the basis signal for each candidate fundamental frequency may be derived using a time domain calibration signal, wherein the time domain calibration signal is transformed into a time domain basis signal using a time delay term which reflects a delay between the start of recording the image charge/current signal and the moment of injection of ions into an ion trap mass spectrometer.

The derivation of a basis signal for each candidate fundamental frequency may account for a decay in an image charge/current signal recorded by an ion trap mass spectrometer over time. In examples discussed below, this is achieved using a decay term $\alpha_i(t)$ The derivation of a basis signal for each candidate fundamental frequency may account for space charge effects on an image charge/current signal recorded by an ion trap mass spectrometer. In examples discussed below, this is achieved using a decay term $\alpha_i(t)$ that is a function of a variable ($A_i$) representative of the number of ions corresponding to the candidate fundamental frequency ($f_i$).

For example, the basis signal for each candidate fundamental frequency may be derived using a time domain calibration signal, wherein the time domain calibration signal is transformed into a time domain basis signal using a decay term that is a function of time and mass/charge ratio, and is optionally also a function of a variable representative of the number of ions corresponding to the candidate fundamental frequency.

One or more time intervals within the image charge/current signal in the time domain may be used for forming the basis signals and/or used in mapping the basis signals to the image charge/current signal.

Thus, in some embodiments, the relative abundances of ions corresponding to the candidate fundamental frequencies may be estimated by mapping the basis signals to one or more portions of the image charge/current signal in the time domain. The/each portion may for example have a duration in the time domain of X ms of the image charge/current signal in the time domain. In some cases, X may be 50 ms or less. In experiments conducted by the inventors, it has been found that this can produce better results. The starting point of the portion of the image charge/current signal may be chosen according to experimental conditions.

The method may include selecting more than one sampling points from the image charge/current signal in the time domain, wherein only the selected sampling points are used for forming the basis signals and/or used in mapping the basis signals to the image charge/current signal.

The image charge/current signal may be acquired (in the time domain) by a single image charge/current detector.

In some embodiments, the image charge/current signal may be derived from image charge/current signals acquired from multiple detectors. For example, the image charge/current signal may be produced by performing a linear combination of image charge/current signals acquired from multiple detectors, as described in Reference [2].

The image charge/current signal is preferably obtained using an image charge/current detector whose frequency spectrum has prominent higher order harmonics, as would be appreciated by a skilled person. An ion trap incorporating such a detector is described, for example, in Reference [4] (see discussion relating to FIG. 4 in particular).

Preferably, the method is carried out after a full image charge/current signal has been acquired. A first image charge/current signal may be processed whilst a second image charge/current signal is being acquired.

The method may include:

if one or more of the estimated relative abundances meets a criterion indicating that a candidate fundamental frequency corresponding to the estimated relative abundance is absent from the image charge/current signal, forming a subset of the basis signals that excludes the one or more basis signals derived for the candidate fundamental frequencies indicated as being absent from the image charge/current signal;

estimating relative abundances of ions corresponding to the candidate fundamental frequencies by mapping the formed subset of the basis signals to the image charge/current signal.

In this way, when the relative abundances indicate that certain candidate fundamental frequencies are absent from the image charge/current signal, then the basis signals corresponding to these candidate fundamental frequencies can be eliminated and the estimating of relative abundances re-performed without the eliminated basis signals, thereby allowing more accurate results to be obtained.

As noted above, each estimated relative abundance may take the form of a respective coefficient, such as $A_i$ discussed in more detail below.

An example criterion indicating that a candidate fundamental frequency corresponding to an estimated relative abundance is absent from the image charge/current signal may include: the estimated relative abundance having a value that is less than a predetermined threshold and/or the estimated relative abundance having a value that is negative.

Another example criterion indicating that a candidate fundamental frequency corresponding to an estimated relative abundance is absent from the image charge/current signal may include: the estimated relative abundance having an intensity that is deemed to be zero or close to zero (e.g. that is zero within a predetermined error threshold).

Thus, in some embodiments, the method may include a further step of estimating relative abundances of ions corresponding to the candidate fundamental frequencies by mapping a subset of the basis signals to the image charge/current signal, wherein the subset of the basis signals excludes any basis signals that mapped to the image charge/current signal with an intensity that is deemed to be zero or close to zero (e.g. that is zero within a predetermined error threshold).

In some embodiments, the method may involve application of an algorithm that implements additional filtering or processing steps, e.g. filtering to remove noise and/or to account for side lobes of peaks in the frequency spectrum.

A polynomial calibration function may be used to calculate a mass/charge ratio dependent offset for the basis signals in the time domain.

A second aspect of the invention may include an apparatus configured to perform a method according to any above aspect of the invention.

The apparatus may include a computer, for example.

The apparatus may be configured to implement, or have means for implementing, any method step described in connection with any above aspect of the invention.

The apparatus may include/be a mass spectrometer. The apparatus may include/be an ion trap mass spectrometer, e.g. an electrostatic ion trap mass spectrometer.

The mass spectrometer may include an image charge/current detector. The mass spectrometer may include multiple image charge/current detectors.

The mass spectrometer may have:

an ion source configured to produce ions;

a mass analyser configured to trap the ions such that the trapped ions undergo oscillatory motion in the mass analyser;

at least one image charge/current detector for use in obtaining an image charge/current signal representative of trapped ions undergoing oscillatory motion in the mass analyser; and a processing apparatus configured to perform a method of processing an image charge/current signal according to any above aspect of the invention.

Preferably, the mass analyser is configured to produce (e.g. using electrodes in the mass analyser) an electric and/or a magnetic field to trap ions produced by the ion source such that the trapped ions undergo oscillatory motion in the mass analyser. Preferably, the mass analyser is configured to produce a substantially static electric field (which may be referred to as an "electrostatic" field) and/or a substantially static magnetic field, e.g. a combination of substantially static electric and magnetic fields (which may be referred to as an "electromagnetostatic" field). Additionally or alternatively, the mass analyser may be configured to produce a dynamic electric field (which may be referred to as an "electrodynamic" field) and/or a dynamic magnetic field, e.g. a combination of dynamic electric and magnetic fields (which may be referred to as an "electromagnetic" field).

If the mass analyser is configured to produce an electrostatic field, the mass analyser may be viewed as an electrostatic ion trap (and the mass spectrometer an electrostatic ion trap mass spectrometer). The electrostatic ion trap may be a linear or planar electrostatic ion trap, for example. The electrostatic ion trap (or a mass analyser of any other type) may have one or more image charge/current detectors. The electrostatic ion trap (or a mass analyser of any other type) may have multiple field forming electrodes at least one of which is also used as an image charge/current detector. In some embodiments, two or more of the field forming electrodes may be used as image charge/current detectors, e.g. as described in Reference [2]

The electrostatic ion trap may have the form of an Orbitrap configured to use a hyper-logarithmic electric field for ion trapping, for example. A conventional Obitrap is configured to use two halves of "outer" electrodes as image charge "pick-up" electrodes, and to pick up the image charge differentially to produce only one image charge signal. However, it is possible to split the outer electrode into more sections, with each generating a respective one of a plurality of image charge/current signals, and/or for part of an inner electrode to be electrically separated and to be properly coupled to allow it to pick-up image charge signals.

The or each image charge/current detector is preferably configured to produce an image charge/current signal representative of trapped ions undergoing oscillatory motion in the mass analyser. Image charge/current detectors are very well known in the art and typically include at least one "pick-up" electrode, and preferably also include at least one "pick-up" electrode and an amplifier (e.g. a "first stage" charge sensitive amplifier). The inclusion of an amplifier in an image charge/current detector is preferred because the amount of image charge induced by the trapped ion is normally less than the charge of the ions, varying between $10^{-19}$ to $10^{-14}$ Coulomb. Low noise charge amplifiers are commonly used to amplify the signal. Because they feature a capacitive impedance at the input, such amplifiers will generally output a signal in waveform of image charge rather than image current. The transmission parameter of this first stage amplifier and following stage amplifier may, however varies from case to case, the obtained signal waveform may vary from image charge type to image current type or any type from their derivatives.

A third aspect of the invention may include a computer-readable medium having computer-executable instructions configured to cause a computer to perform a method according to any above aspect of the invention.

The invention also includes any combination of the aspects and optional/preferred features described except where such a combination is clearly impermissible or expressly avoided.

For example, the general aspect of the present invention may be combined with any of the optional/preferred features described in connection with the first aspect of the invention (i.e. without necessarily requiring at least one candidate fundamental frequency to be calculated using a frequency associated with a peak that falls outside the frequency range of interest and that has been determined as representing a second or higher order harmonic of the candidate fundamental frequency), except where such a combination is clearly impermissible or expressly avoided.

BRIEF DESCRIPTION OF THE DRAWINGS

Examples of these proposals are discussed below, with reference to the accompanying drawings in which:

FIG. 3 shows detected peak frequencies and their possible harmonic numbers before and after validation.

FIG. 5 shows a test ion cloud composition.

FIG. 8 shows a list of masses detected in Phase 1 of the algorithm.

FIG. 9 shows a comparison of true and detected mass intensity pairs in a test ion cloud.

DETAILED DESCRIPTION

Figure 1:
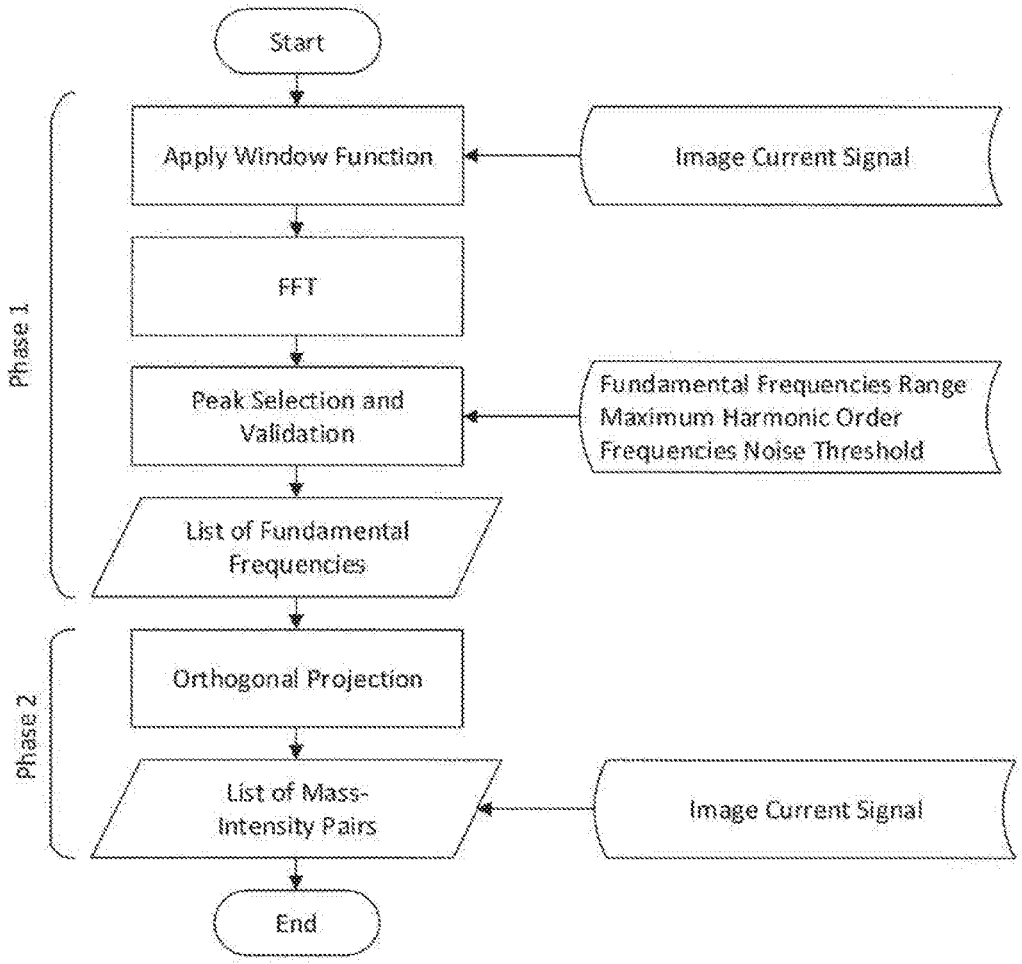
FIG. 1 shows phases of the data processing algorithm.

In general, the following discussion describes examples of our proposals that involve processing an image charge/current signal representative of trapped ions undergoing oscillatory motion by:

- identifying a plurality of candidate fundamental frequencies potentially present in the image charge/current signal based on an analysis of peaks in a frequency spectrum corresponding to the image charge/current signal in the frequency domain, wherein each candidate fundamental frequency falls in a frequency range of interest;
- deriving a basis signal for each candidate fundamental frequency using a calibration signal; and
- estimating relative abundances of ions corresponding to the candidate fundamental frequencies by mapping the basis signals to the image charge/current signal;
- wherein, at least one (preferably each) candidate fundamental frequency is calculated using a frequency associated with a peak that falls outside the frequency range of interest and that has been determined as representing a second or higher order harmonic of the candidate fundamental frequency.

In particular, in the following examples, an image charge/current signal representing a bunch of unknown ion species is subjected to a fast Fourier Transform ("FFT"). The resulting frequency spectrum is analysed in order to extract a set of fundamental frequencies corresponding to the unknown ion species. This extraction is carried out in such a way that the highest possible harmonics of the fundamental frequencies are used for calculation of the fundamental frequency. This improves the accuracy and the resolving power of the method.

A special validation procedure is used to exclude those peaks that are not produced by primary harmonics of the image charge/current signal with fundamental frequencies that fall within a specified frequency range of interest.

A set of basis signals is calculated using the set of fundamental frequencies obtained at the previous stage. In order to calculate the intensities of the basis signals, they are utilized in an Orthogonal Projection Method ("OPM", see Reference [1]) applied to the original image charge/current signal. The obtained intensities of the basis signals are equal to the relative abundances of various ion species that produced the original image current signal.

The method described in the following pages provides the following advantages compared with the references described in the background section:

- No additional hardware modifications are required, because just one signal from a single pick-up detector can be used. Some of the methods discussed in the Background section require use multiple detectors (see e.g. Reference [2]), which makes the instrument more expensive.
- No inherent restriction on mass range (whereas in Reference [2] the mass range depends on and is restricted by the number of pick-up detectors)
- The highest harmonics are used for calculating fundamental frequencies, which results in obtaining the highest possible accuracy and resolving power for this instrument. In contrast, Reference [1] discussed in the Background section teaches use of only the first harmonic to obtain frequencies.
- Application of an Orthogonal Projection Method to the selected basis signals results in improved calculation of the relative ion abundances from an FFT power spectrum compared with Reference [1], where the masses used to derive the basis signals are uniformly spaced along a mass range of interest.

In the present method, an image charge/current signal obtained from at least one pickup detector of the EIT analyser is used as the only input to a novel data processing method, which is split into two phases, as shown in FIG. 1.

In phase 1, a fast Fourier transform of the input image charge/current signal is carried out using a window function and the results of this FFT are processed in order to obtain a list of candidate fundamental frequencies corresponding to the mass/charge ratios of the ions that produced the input image charge/current signal.

In phase 2 the Orthogonal Projection Method ("OPM") is applied where the input image charge/current signal is projected onto the basis signals calculated using the list of candidate fundamental frequencies obtained in phase 1. The results of the projection are filtered to remove any spurious frequencies and obtain the final list of fundamental frequencies and intensities that correspond to ion mass/charge ratios and their abundances in the input image charge/current signal.

For simplicity in all further explanations we will refer to frequencies and intensities rather than mass/charge ratios and abundances, but these terms may be used interchangeably herein. This is because (1) there is a one-to-one relationship between a frequency in a Fourier spectrum and a mass/charge ratio; (2) the intensity figures calculated in phase 2 of the method are in fact the abundances of the corresponding ion species.

Phase 1

As mentioned above, the image charge/current signal is subjected to an FFT. Depending on the preferred compromise between the dynamic range and the mass/charge ratio accuracy, a window function could be used with the required dynamic range and the signal could be padded with zeros.

For simplicity, consider an idealized Fourier spectrum where each of the frequencies is represented by a delta function. We may assume that all fundamental frequencies in the spectrum fall within a certain frequency range of interest, known in advance. This is because there will always be some sort of mass/charge ratio filtering before the EIT analyser and the low and high limits of mass/charge ratios will be known in advance. This in turn means that the fundamental frequencies (i.e. first harmonics) in the image charge/current signal corresponding to the mass/charge ratios in the EIT analyser are known in advance to be in a frequency range of interest between $F_{MIN}$ and $F_{MAX}$.

Figure 2:
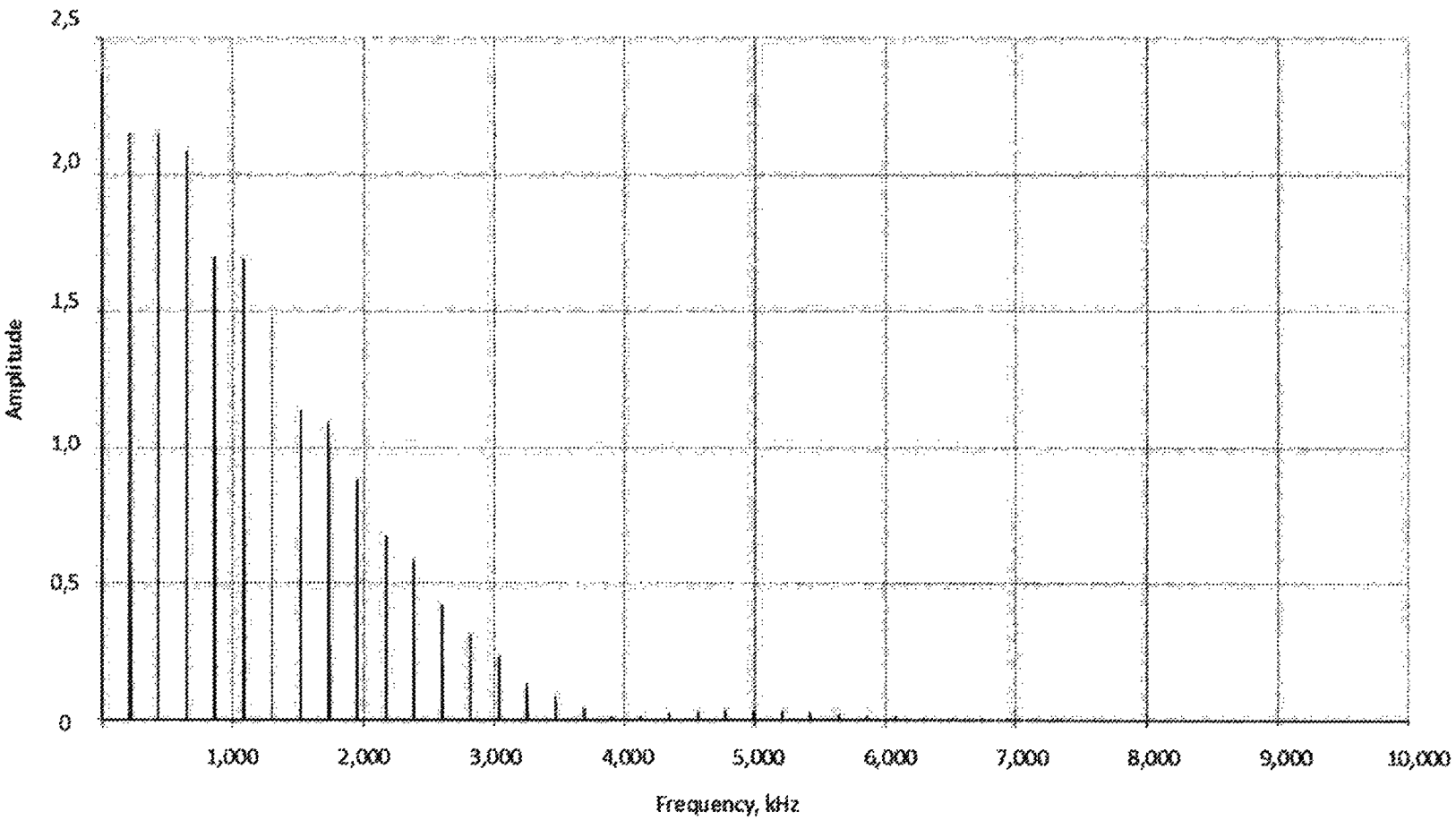
FIG. 2 shows a typical Fourier spectrum of a group of ions with the same mass/charge ratio.

The method is also based on an observation that the higher order harmonics of an EIT analyser's image charge/current signal typically fade away very fast. A typical FFT spectrum of a group of ions with the same mass/charge ratio acquired from an EIT analyser is shown in FIG. 2. Therefore we can also assume that even for the most abundant ion there is a certain harmonic number M such that all harmonics with harmonic numbers greater than M are small compared to the first few harmonics so that they do not need to be taken into account in further calculations. M can be referred to as a predetermined maximum harmonic number. For example, in FIG. 2 the value of M could be chosen to be 30. The value of M depends on the characteristics of a particular EIT and could be determined during algorithm tuning.

Based on the above assumptions we can define a validation frequency range from $F_{MIN}$ to $M \times F_{MAX}$, where M is an integer. In this frequency range we will not be looking for harmonics higher than M, as they are considered to be too small.

The method starts with finding a peak with a frequency closest to, but lower than, $M \times F_{MAX}$. Let $F_x$ be this frequency. $F_x$ could potentially represent an Nth order harmonic of a fundamental frequency $F_{ON}=F_x/N$, where N=1, 2, 3 . . . M. However, the values of N must be chosen such that the corresponding values $F_{ON}$ are in the predetermined frequency range of interest, FRI, from $F_{MIN}$ to $F_{MAX}$ (see above). Let us consider an example with reference to FIG. 3.

The FRI in FIG. 3 is chosen to be from 200 kHz to 1,000 kHz. The full list of detected peaks in the FFT spectrum of the image charge/current signal is presented in the 'Detected Peaks' column. Let us assume, for simplicity, that the highest harmonic of interest is 10 (i.e. M=10). For each detected peak, starting with the highest frequency detected peak at 2,000 kHz, we can compose a list of harmonic numbers corresponding to the not-yet-validated harmonics that this peak could represent (column 'before validation'). For example, the peak at 2,000 kHz could be the tenth order harmonic of a fundamental frequency 200 kHz, ninth order harmonic of a fundamental frequency 222.222 kHz, eighth order harmonic of a fundamental frequency of 250 kHz, etc. The lowest harmonic that this peak could represent is a second order harmonic, which corresponds to a fundamental frequency of 1,000 kHz. Note that although the peak at 1,900 kHz could be the tenth harmonic corresponding to a fundamental frequency 190 kHz, we have to drop this signal since its fundamental frequency is outside the FRI, so the highest possible harmonic number for this peak is 9. Similarly we can calculate the sets of possible harmonic numbers for all other peaks. For the peaks in the FRI, the lowest possible value of their harmonic number is 1.

Thus, for each peak in an FFT spectrum we have a set of possible harmonic numbers, each of which, or a combination of which, could potentially correspond to this peak. We then need to validate each of the harmonic numbers in each of the sets. Here is how the validation procedure is carried out.

Again, we start with the highest frequency peak at 2,000 kHz. Let us assume that it represents the tenth harmonic of a fundamental frequency 200 kHz. If this is the case, then we should be able to find the ninth, eighth, seventh etc. harmonics of this fundamental frequency. We can see that peaks at 1,400 and 200 kHz corresponding to the seventh and first harmonics are absent. This means that the fundamental frequency of 200 kHz is not present in the given spectrum and should be excluded from all further validation checks. After carrying out similar checks for the remaining possible values of the harmonic number corresponding to this peak, we can see that the peak at 2,000 kHz could represent only the fifth, fourth and second harmonics of the fundamental frequencies of 400, 500 and 1,000 kHz respectively, or a combination of such harmonics.

It is interesting to note that according to this validation procedure, the peaks at 1,900 and 1,500 kHz could not represent harmonics of a frequency that falls in the FRI. These peaks should therefore be treated as invalid and should be excluded from the list of validated peaks.

After this validation procedure has been applied to each peak, we have a (reduced) list of validated peaks, each of which has an associated (reduced) list of possible harmonic numbers that could correspond to the peak (column 'after validation'). From this list of validated peaks, the peaks having 1 as their lowest possible harmonic number are identified as corresponding to candidate fundamental frequencies, where each fundamental frequency falls in the FRI.

There are several important points that have to be noted at this stage:

1. Not all identified candidate fundamental frequencies necessarily represent an actual fundamental frequency in the image charge/current signal (hence the use of the term "candidate"). For example, although the peaks at 800 and 1,000 kHz in FIG. 3 are candidate fundamental frequencies, they could in principle be the second harmonics of fundamental frequencies 400 and 500 kHz. Whether these peaks are actual fundamental frequencies in the image charge/current signal can only be determined in the second phase of the method (see below).
2. Each of the fundamental frequencies is calculated using the value of the frequency of the highest available (preferably Mth order) harmonic of that fundamental frequency. This results in higher frequency (mass/charge ratio) accuracy and is one of the advantages of the method.

3. In practice it is more efficient to perform validation as soon as a new peak is extracted from the spectrum (starting with the peak that has a corresponding frequency closest to $F_{MAX} \times M$ and continuing with the others of the multiple test peaks in decreasing order of their associated frequencies) rather than first extracting all peaks and then validating them as described here (for simplicity of explanation).
4. The real implementation of this phase of the algorithm may be more complex and more efficient than described here. For example, the peaks in a real spectrum will have a finite width, and the image charge/current signal may contain noise. An algorithm including additional filtering and/or processing steps which are known in the art of signal processing may therefore be used. These features are omitted here for reasons of clarity.
5. An absorption, rather than power, spectrum could be used for peak selection.

The validation procedure described above of selecting and validating fundamental frequencies corresponds to the 'Peak Selection and Validation' box in FIG. 1. There are many ways to implement this procedure. One of the possible algorithms is displayed in FIG. 4.

Figure 4:
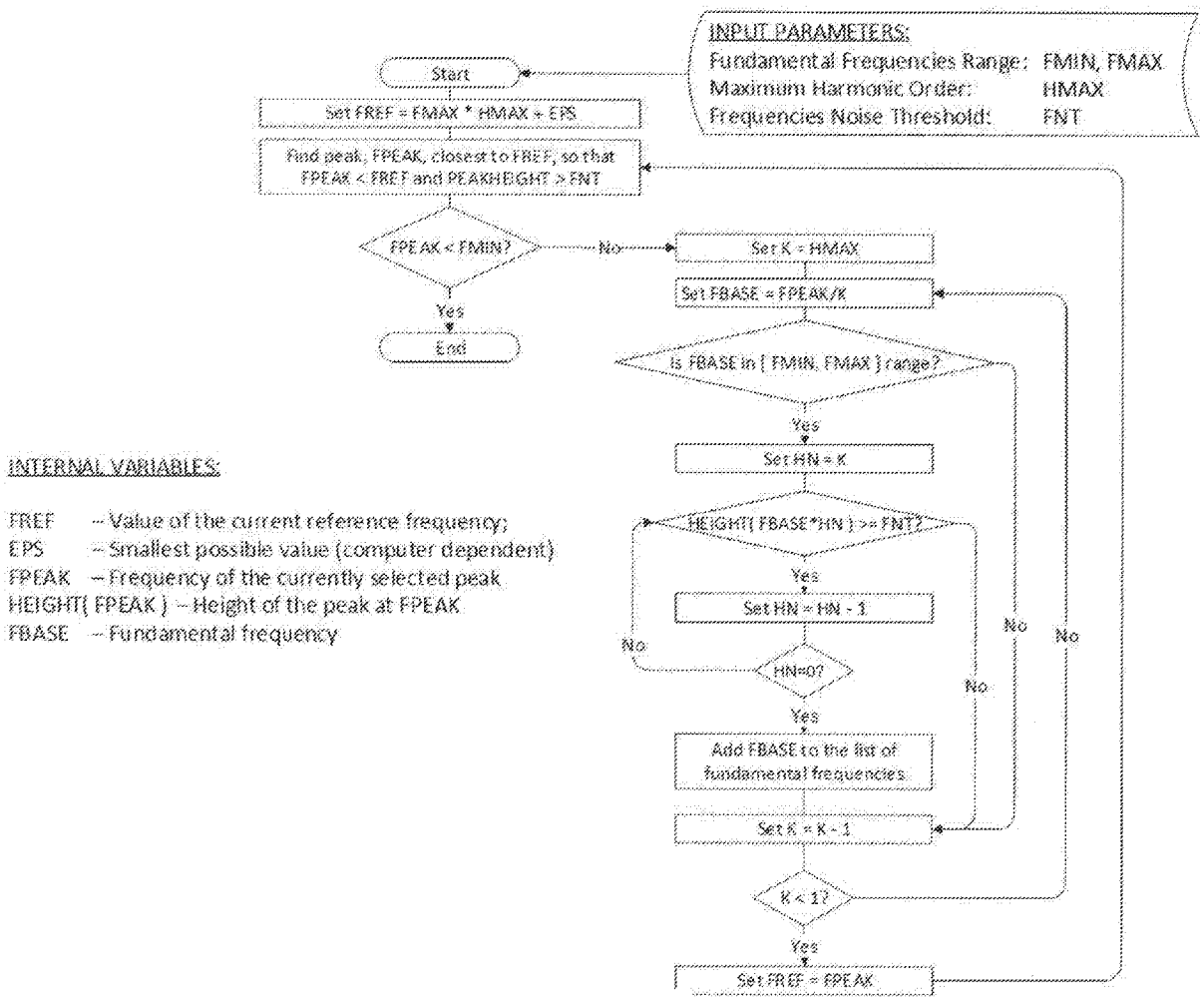
FIG. 4 shows a possible implementation of the peak selection and validation algorithm.

Note that the algorithm shown in FIG. 4 has been simplified for illustrative purposes, such that the algorithm would result in multiple values calculated for the same fundamental frequency appearing in the list of fundamental frequencies, wherein each value calculated for a given fundamental frequency is calculated using a different order harmonic of that fundamental frequency. In practice, the algorithm would preferably be modified to avoid this duplication, e.g. by checking if a newly calculated value relates to the same fundamental frequency as a previously calculated value. Such modifications would be well within the capability of the skilled person, but have not been included here so as to avoid obscuring the underlying concepts discussed above.

Phase 2

We arrive at Phase 2 with a plurality of candidate fundamental frequencies, each of which falls within the FRI, where each of the fundamental frequencies is calculated using the highest possible harmonic of the fundamental frequency. In Phase 2 we want to estimate the intensities corresponding to these candidate fundamental frequencies. This is achieved through the use of the orthogonal projection method, the OPM.

Conceptually the OPM is concerned with finding the 'best fit' approximation of a given signal with a linear combination of a predetermined set of so-called 'basis signals'. The basis signals are not necessarily orthogonal to each other, which means their scalar products are not necessarily 0.

Thus we assume that the image charge/current signal could be represented by a linear combination of basis signals whose fundamental frequencies correspond to the candidate fundamental frequencies obtained in Phase 1. For simplicity, in the following discussion relating to deriving basis signals, we refer to "mass" instead of "mass/charge ratio".

Example Techniques for Obtaining Basis Signals for Use in an OPM Method

Each of the candidate fundamental frequencies can be used to calculate a basis signal using a calibration signal for a known mass. Thus, an ith candidate fundamental frequency $f_i$ can be used to calculate a respective basis signal $X_i(t)$ using a calibration signal $I_c(t)$ for a known calibration mass $m_c$.

For example, a signal intensity $I_i(t)$ for an ith candidate mass $m_i$ could be defined with respect to the calibration signal $I_c(t)$ for a known calibration mass $m_c$ using the formula:

$$I_i(t) = \frac{A_i}{A_c} \times I_c\left(t \times \frac{\sqrt{m_c}}{\sqrt{m_i}}\right) \tag{1}$$

Here, t is a time position in the time domain of the image charge/current signal that is being calculated, $A_c$ is representative of the (relative) number of ions used for the calibration signal; $A_i$ is representative of the (relative) number of ions of candidate mass $m_i$ in the image charge/current signal that is being calculated. Interpolation may be carried at time positions $$t \times \frac{\sqrt{m_c}}{\sqrt{m_i}}$$

where $I_c(t)$ is not provided

In Equation (1), the signal intensity $I_i(t)$ for an ith candidate mass $m_i$ depends on an intensity $I_c(t)$ of a calibration signal for a known calibration mass $m_c$ such that $I_i(t) \propto I_c(t \times \sqrt{m_c}/\sqrt{m_i})$. The ith candidate mass $m_i$ depends on the fundamental frequency $f_i$ associated with the candidate primary harmonic for the ith candidate mass $m_i$ such that $m_i \propto f_i^{-2}$ (see e.g. Equation (8) of Reference [1]). Hence the signal intensity $I_i(t)$ corresponds to a version of the calibration signal $I_c(t)$ which has been stretched in the time domain in a manner depending on the ratio $\sqrt{m_c}/\sqrt{m_i}$.

When performing an OPM, $A_i$ (representative of the relative number of ions of candidate mass $m_i$) is typically an unknown quantity. And therefore, for performing an OPM, a basis signal $X_i(t)$ for the ith candidate mass $m_i$ may be defined as follows:

$$X_i(t) = \frac{I_i(t)}{A_i} = \frac{1}{A_c} \times I_c(\sqrt{m_c/m_i} \times t) \tag{2}$$

In a typical ion trap mass spectrometer, there will generally be a time offset between ions of different $m_i$, because after injection of ions into the ion trap mass spectrometer, the ions of different $m_i$ will reach an image charge/current detector (e.g. a detection electrode) at different times (offset times). Note that in general, all masses will be injected into the ion trap mass spectrometer at the same time. Time offset for an ith candidate mass $m_i$ may be determined as the time difference between the time at which the ion cloud of mass $m_i$ is injected into the ion trap mass spectrometer and the time at which the ion cloud reaches its closest location with respect to an image charge/current detector (which may correspond to a maximum in the image charge/current signal).

Therefore, in practice, Equation (2) may be modified to provide the basis signal for an ith candidate mass $m_i$ as follows:

$$X_i(t) = \frac{1}{A_c} \times I_c(\sqrt{m_c/m_i} \times (t - \tau_i) + \tau_c) \quad (3)$$

where $\tau_i$ and $\tau_c$ are time offsets corresponding to the ith candidate mass $m_i$ and to the calibration mass $m_c$, respectively. Time offset $\tau$ is a function of mass m and can be pre-calculated in simulations or pre-measured experimentally.

Sometimes it is necessary to start recording an image charge/current signal with a time delay $\Delta t$ with respect to the moment of injection of ions into an ion trap mass spectrometer. Since all masses will in general be injected into the ion trap mass spectrometer at the same time, $\Delta t$ can be viewed as being constant for all masses.

For example, a time delay $\Delta t$ may be needed to avoid any electronical perturbations which damp for some time after the initial injection of ions and which may adversely affect the measured image charge/current signal.

In order to take $\Delta t$ into account, Equation (2) may be modified to provide the basis signal for an ith candidate mass $M_i$ as follows:

$$X_i(t) = \frac{1}{A_c} \times I_c(\sqrt{m_c/m_i} \times (t - \tau_i - n_c T_i + \Delta t) + \tau_c + n_c T_c - \Delta t) \quad (4)$$

Where $$n_c = \left[\frac{t_{c1} - \tau_c + \Delta t}{T_c}\right] \quad (5)$$

And where $n_c$ represents number of peaks in the calibration signal that would have been measured for the mass $m_c$ between the injection moment and the start of the recording (which may be calculated according to Equation (5)), $T_i$ is time distance between adjacent peaks (=period of image charge/current signal in the time domain) for the mass $m_i$, $t_{c1}$ is the time of the first peak in the recorded calibration signal for the mass $m_c$, $T_c$ is time distance between adjacent peaks for the calibration mass $m_c$, $\Delta t$ is as defined above.

Equation (4) therefore provides a basis signal $X_i(t)$ for an ith candidate mass $m_i$ that accounts for both time offsets ($\tau_i$) and a time delay $\Delta t$ as described above.

An equivalent to Equation (4) can be obtained from Equation (3), by defining a time offset $\tau'_i$ that also takes account of a possible time delay $\Delta t$ as follows:

$$\tau'_i = \tau_i + n_c T_i - \Delta t \quad (6)$$

and substituting Equation (6) into Equation (3) to obtain:

$$X_i(t) = \frac{1}{A_c} \times I_c(\sqrt{m_c/m_i} \times (t - \tau'_i) + \tau'_c) \quad (7)$$

In some cases it is acceptable to omit $n_c$ in the above equations, i.e. put $n_c$=0. For example, this may be justified when a calibration signal decay is relatively small so that amplitude is not changed over $n_c$ periods of the signal.

As would be appreciated by a skilled person, the discussion above provides just one example of how a set of basis signals $X_i(t)$ might be defined for each candidate mass $m_i$, and alternative definitions could be formulated, e.g. to take other factors/variables/considerations into account, e.g. to produce more accurate results.

For example, in order to make the basis signals $X_i(t)$ for each candidate mass $m_i$ even closer to the component of an image charge/current signal caused by that candidate mass $m_i$, the amplitude of the basis signal could be made a function of time. This is because the envelope of the calibration signal for a known calibration mass $m_c$, which could be measured or simulated under realistic conditions, will typically decay with time according to the initial conditions of the ion cloud prior injection and focusing properties of the ion trap. Such realistic conditions may, for example, include an ion cloud having non-zero spatial and kinetic energy distributions prior to injection, which will in general be functions of mass.

To make the amplitude of the basis signal a function of time, a new term $\alpha_i(t)$ could be introduced. For example, introducing $\alpha_i(t)$ into Equation (7) may provide:

$$X_i(t) = \frac{1}{\alpha_i(t) A_c} \times I_c(\sqrt{m_c/m_i} \times (t - \tau'_i) + \tau'_c) \quad (8)$$

Function $\alpha_i(t)$ represents the change in amplitude $A_c$ over time relative to the amplitude of the signal of the ith candidate mass $m_i$. The function $\alpha_i(t)$ could similarly be introduced into Equations (2) or (4).

A possible method for calculating $\alpha_i(t)$ for an ith candidate mass $m_i$ may involve first calculating reference functions $\alpha_{cp}(t)$ for each of a set of calibration masses $m_{cp}$(p=0, . . . , k) using a set of calibration signals (measured or simulated) that each corresponds to oscillation of a respective calibration mass $m_{cp}$ in the set, e.g. using the following equation (which defines a ratio with respect to a basis signal $X_c(t)$ corresponding to the calibration mass $m_c$):

$$\alpha_{cp}(t) = \frac{X_c(t)}{X_{cp}\left(\sqrt{m_{cp}/m_c}\,(t - \tau_{cp}) + \tau_{c0}\right)}, \; p = 0, \ldots k \quad (9)$$

It may be preferable to calculate $\alpha_{cp}(t)$at the points t where $X_c(t)$ has peaks, i.e. maximal values, in order to get rid of noise at the time points between the peaks. A set of curves $\alpha_{cp}(t)$ can be viewed as forming a 3D surface $\alpha(m, t)$ which refers to the calibration mass $m_c$. If we decide to use another $m_c$ in order to fit another candidate mass $m_i$, we have to calculate new $\alpha(m, t)$ dependence.

Values of $\alpha_i(t)$ used in (8) can be obtained from the obtained dependence $\alpha(m, t)$) by means of 2D interpolation with respect to the candidate mass and time.

Example Technique for Using Basis Signals in an OPM Method

Having obtained a set of basis signals $X_i(t)$ for each candidate mass $m_i$, e.g. as set out above, we apply an OPM to find the coefficients $A_i$ of the basis signals in a linear combination to fit to a measured image charge/current signal I(t).

$$I(t) = \sum_{i=0}^{n} A_i X_i(t) \quad (10)$$

The values of the coefficients $A_i$ in this linear sum are linearly proportional and therefore representative of the (relative) number of ions of candidate mass $m_i$ that formed the image charge/current signal. The coefficient of proportionality could be established from the known intensity of the calibration signal and the known number of ions used to form the calibration signal.

As would be appreciated by a skilled person, the OPM may take other factors/variables/considerations into account, e.g. to produce more accurate results.

For example, if recording an image charge/current signal I(t) is started with the delay Δt and the largest candidate mass $m_{MAX}$ is larger than the calibration mass $m_c$, then part of the recorded signal I(t) should be cut or otherwise disregarded from the beginning of the recorded signal in order for the orthogonal projection method to produce useful results. Namely all points with $$t<\tau_{max}+n_cT_{max}-\Delta t \tag{11}$$

should not be used in the recorded signal for the purposes of the orthogonal projection fitting. Here t is the time from the start of the recording, $m_{max}$ is the largest candidate mass, $\tau_{max}$ is the time offset associated with the largest candidate mass, $T_{max}$ is time distance between adjacent peaks (=period of signal in the time domain) for the largest candidate mass, $n_c$ is determined for the calibration mass according to Equation (5).

Example Techniques for Using Phase Information to Obtain Basis Signals for Use in an OPM Method A technique for obtaining a basis signal $X_i(t)$ for a candidate mass $m_i$ using phase information obtained from a Fourier transform ("FT"), such as a Fast Fourier Transform ("FFT"), of the time domain signal I(t) will now be described.

As is known in the art, the FT of a time domain signal I(t) will contain complex value for each frequency on the FT spectrum that can be represented as magnitude and phase values for each frequency on the FT spectrum.

According to this technique, a relationship between mass and phase is established from a set of one or more calibration signals measured for different masses which are suitable for a mass range of interest. This relationship may be established from one harmonic component included in the FT of the one or more calibration signals, e.g. the first harmonic component included in the FT of the one or more calibration signals.

An initial phase value $\varphi_i$ for an ith candidate mass $m_i$ in the FT of the signal I(t) can be obtained from the relationship between mass and phase (established as indicated in the previous paragraph) by means of interpolation. A calibration signal of one mass, preferably a calibration signal of a calibration mass chosen to be closest to the ith candidate mass $m_i$, can then be transformed using the initial phase value $\varphi_i$ via shift and stretch/compression of the time axis.

For example, initial phase value $\varphi_i$ for a candidate mass $m_i$ may be related to the offset time $\tau_i$ as:

$$\tau_i = \frac{\varphi_i}{2\pi v_i} \tag{12}$$

where $v_i$ is the frequency of the peak corresponding to the candidate mass $m_i$ in the frequency spectrum.

The advantage of calculating time offset $\tau_i$ via initial phase value $\varphi_i$ is larger accuracy due to the phase value $\varphi_i$ being averaged over many oscillations. In contrast, time offsets taken as a first peak time position from the real signal may be not so accurate, for example, due to relatively large noise.

Equation (12) assumes Δt=0, i.e. no time delay.

If there is a time delay, i.e. Δt≠0, then the/each measured calibration signal will be shifted by Δt along the time axis so that the first measured point is located at t=Δt. The points in the interval [0;Δt] are set to zero values assuming that zero time corresponds to the injection time. This operation allows to estimate initial phases of ions so that Equation (12) can be used. The initial phase value $\varphi_i$ for an ith candidate mass $m_i$ can be derived from the discrete Fourier transform ("DFT") of such corrected signal. Any basis signal can be derived from the calibration signal as follows:

$$X_i(t) = \frac{1}{A_c} \times I_c\left(\sqrt{m_c/m_i}\left(t - \frac{\varphi_i}{2\pi v_i}\right) + \frac{\varphi_c}{2\pi v_c}\right) \tag{13}$$

where $\varphi_c$ is the initial phase value for the calibration mass $m_c$ and $v_c$ is the frequency value corresponding to the calibration mass $m_c$.

Phase can be determined from the DFT data as an argument of a complex number F taken at the frequency $f_i$, where magnitude spectrum has a maximal value: $\varphi_i$=arg(F($f_i$)). Phase can be calculated for the whole signal length for better accuracy, or for the part of the signal. For example, the length of the signal which is used for the fitting, may be preferable if the phase drifts when analysing DFT of signals recorded over longer time periods.

In experimental conditions φ(m) dependence is generally not constant but rather its shape is determined by the injection conditions of a device. Another possible reasons for that are: delay time Δt is not known precisely, or there are distortions of the static field during relaxing period after ion injection. Because of that, in order to calculate $\varphi_i$ value for any candidate mass a curve $\varphi_p(m_p)$ (p=0, . . . ,k) should be calculated for a set of calibration signals, then it should be interpolated for any candidate mass falling into the respective interval [$m_0$; $m_k$].

Dependence of φ(m)on m may be quite steep: if the phase values span is more than 2π it will be wrapped and function will have points of discontinuity. Equation (13) can still be used, but it can be problematic to interpolate initial phases for masses which are close to the discontinuity points. Such problem can be solved by changing Δt value when add zeros in front of a measured signal. For example, if φ(m) is wrapped for the current Δt value we add or remove one sampling step and calculate φ(m) again. This will result in rotation of the dependence and potentially can make φ(m) values span within 2π. The necessary addition to Δt can be determined in iterations until we find appropriate value.

Depending on whether calibration mass $m_c$ is smaller or larger than the candidate mass $m_i$ we will need to discard part of measured signal or part of the obtained basis signal, respectively. It is preferable to choose calibrations mass closest to a candidate mass to minimize points discarding.

Additional Considerations

There are several important points that have to be noted at this stage:

1. If the coefficient of a basis signal corresponding to a candidate fundamental frequency turns out to be very small (e.g. smaller than some predetermined threshold), it may be inferred that this candidate fundamental frequency has no significant presence in the signal and its contribution to any peak in the frequency spectrum is negligible. With reference to the table in FIG. 3, the peaks at 800 and 1,000 kHz could potentially be such peaks, but this can only be established in Phase 2 after the OPM. Such peaks may for example result from a linear combination of second or higher order harmonics of other fundamental frequencies.

2. If the coefficient $A_i$ of a basis signal corresponding to a candidate fundamental frequency turns out to be very small (e.g. smaller than some predetermined threshold) and/or negative, then that candidate fundamental frequency may be disregarded as a candidate fundamental frequency (thereby reducing the number of candidate fundamental frequencies), and Phase 2 of the algorithm may be repeated on this reduced set of candidate fundamental frequencies. This repetition of Phase 2 may continue until the coefficients $A_i$ of all basis signals corresponding to the candidate fundamental frequencies are larger than a predetermined threshold and positive (i.e. so that none of the coefficients are very small or negative). For the avoidance of any doubt, performing the repetition of Phase 2 with a reduced set of candidate fundamental frequencies does not require the basis signals to be recalculated.
3. An advantage of using an OPM in the manner disclosed herein (wherein, at least one candidate fundamental frequency is calculated using a frequency associated with a peak that falls outside the frequency range of interest and that has been determined as representing a second or higher order harmonic of the candidate fundamental frequency) is that the derived set of basis signals includes the 'true' signals. Only these 'true' signals should be detected as having non-zero intensities. The original way of using an OPM disclosed in Reference [1] instead used a set of basis signals with fundamental frequencies that were evenly spaced over a predetermined frequency range.
4. One or more calibration signals distributed over the mass/charge ratio range could be used to improve accuracy of the calculated basis signals.
5. Rather than using raw signals for the OPM, one can use signals that are reconstituted from their FFT spectra. The reconstitution could be carried out by first performing the FFT, then selecting the most significant peaks of the resulting frequency spectrum and using these peaks for the reverse FFT to get the 'reconstituted' signal.
6. In some cases it may be desirable or even necessary to take space charge effects into account for better fitting result. Space charge effects may result in additional ion cloud spread, i.e. signal envelope decay. In this case envelope function $\alpha_i(t)$ will decay differently with time depending on (relative) number of ions A in the ion cloud. This effect can be remarkable for signals recorded over a long time period which are then used in Phase 2, i.e. the fitting phase. Therefore, $\alpha_i(t)$ can be viewed as a function of $A_i$ in addition to being a function of $m_i$ and t, i.e. $\alpha_i(m_i,t,A_i)$. As a skilled person would appreciate, $\alpha(m, t, A)$ could be pre-measured or pre-simulated (under space-charge conditions) for various combinations of m and A. When performing a method according to the invention, $A_i$ is unknown and so an iteration process may be used. This iteration process may include: (i) performing the orthogonal projection method under no space charge conditions (e.g. as described previously, using e.g. Equation (8) to obtain the basis signals) to obtain a value of $A_i$ for each candidate mass $m_i$; then (ii) for each candidate mass $m_i$ the obtained value of $A_i$ could be used together with the pre-measured/pre-simulated alpha values to obtain a refined basis signal that does take space charge conditions into account; then (iii) performing the orthogonal projection method using the refined basis signals to obtain updated $A_i$ values. Steps (ii) and (iii) can be repeated using the updated $A_i$ values as many times as needed.

Simulation Data

We have simulated an image current signal produced by a cloud of ions of the composition shown in FIG. 5.

Figure 6:
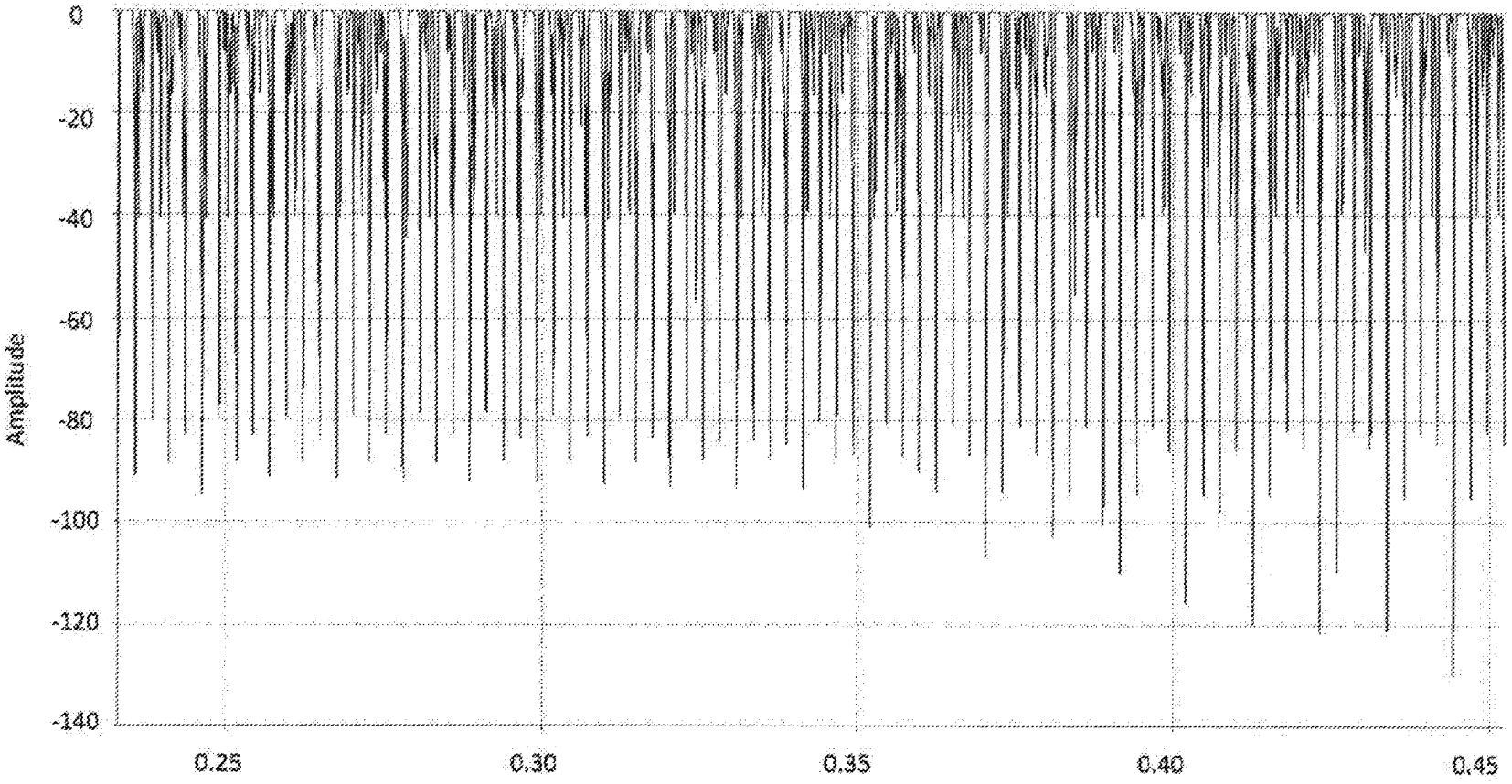
FIG. 6 shows a section of a test ion cloud's raw signal.
Figure 7:
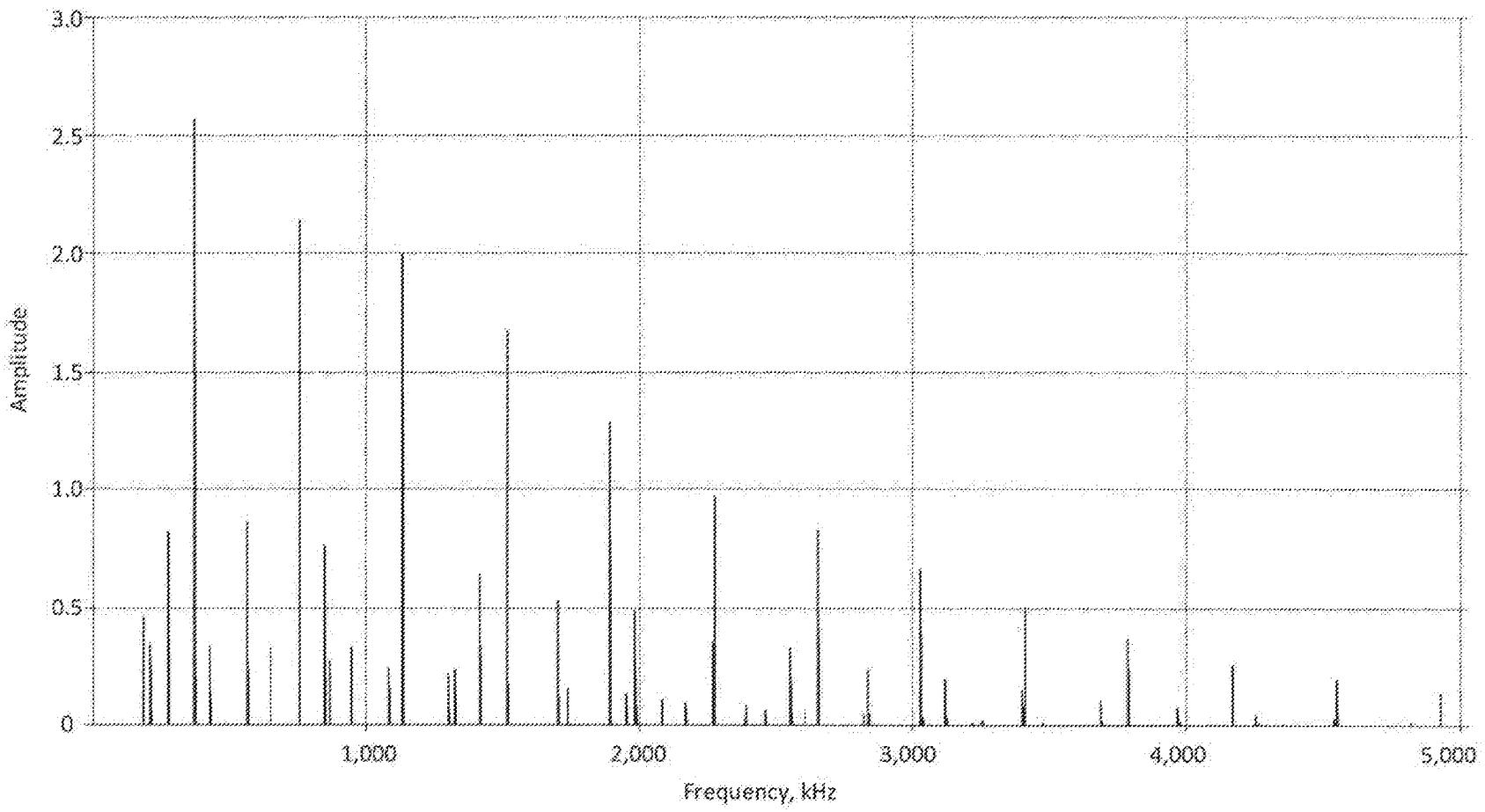
FIG. 7 shows a section of the Fourier spectrum of a test ion cloud's signal.

The signal was generated from a single calibration signal using the formula in Equation (1). In this simplified experiment no phase shift for different mass/charge ratios or noise were introduced. The first 0.45 ms of the raw image current/charge signal acquired for 400 ms is presented FIG. 6. FIG. 7 shows a section of its Fourier spectrum.

In this particular experiment the mass/charge ratio range of interest was from 150 to 2,500 Da and the maximum harmonic order was M=25.

FIG. 8 shows a list of mass/charge ratios detected in phase 1 of the method. These mass/charge ratios were used to calculate a set of the basis signals using a calibration signal for mass/charge ratio 609.7 Da. In phase 2 of the method we used the first 15 ms of the raw image charge/current signal for the orthogonal projection. FIG. 9 shows a comparison table with the true and detected mass-intensity pairs (the masses are rounded to 3 digits after the decimal point, the intensities are rounded to an integer number of ions).

The other methods mentioned in the background section did not deliver such good results even for this simplified ion composition. There were either false peaks or the intensities were not accurate with errors of 20% at best or mass/charge ratios like 200 and 800 Da were not distinguished.

In some embodiments, it may be advantageous to map the basis signals to only a portion of the image charge/current signal in the time domain. For example, in simulations performed by the inventors, mapping the basis signals to the first 50 ms of the image charge/current signal in the time domain was found to produce better results. This is because the initial part of the image charge/current signal is usually the least corrupted by space charge influence. In reality, after the ions are injected into an ion trap by pulsing an electric gating signal, there will be a short period of time where high EM noise overwhelms the image charge/current signal. This is often 2-3 ms, and signal quality is badly interrupted, so we normally avoid using image charge/current signal acquired during this short period of time. Therefore the "first 50 ms of time image charge/current signal in the time domain" preferably means from 3 ms to 50 ms.

Figure 10:
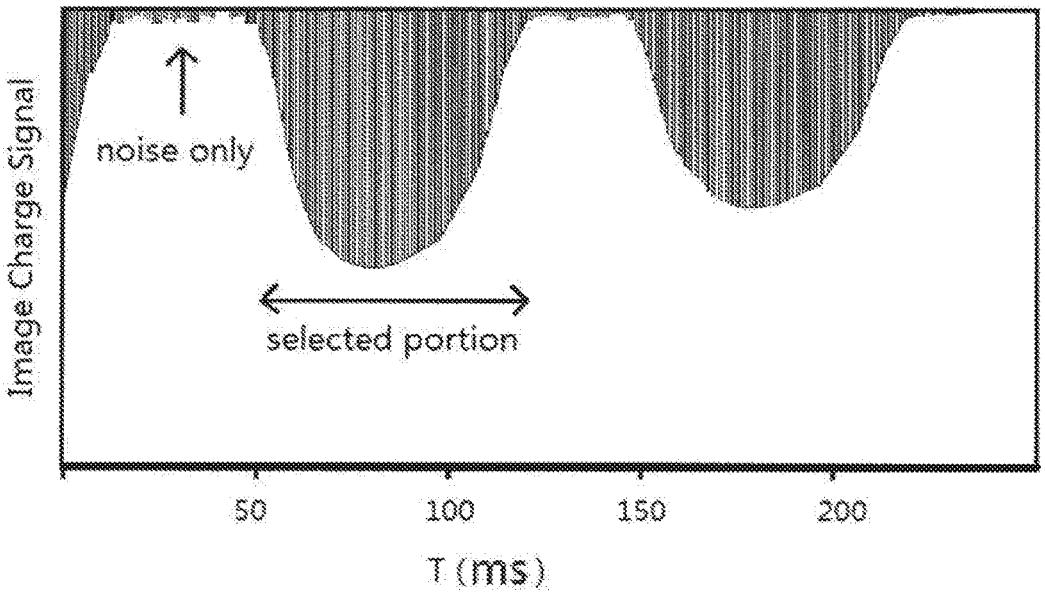
FIG. 10 illustrates an image charge signal in the time domain that appears as a beating signal in which wave packets only exist at certain time intervals.

There might be other situations where other portions of the image charge/current signal may produce better results. For example, when ions contain mostly a group of ions with close mass values, such as ions in an isotope cluster. The image charge signal in this case may appear as a beating signal in which wave packets only exist at certain time intervals, so the portion would preferably be chosen accordingly. This is illustrated in FIG. 10.

Possible Optimisations

The inventors found that the method produced the best results under the following conditions:

1. The image current signal is acquired for no less than 200 ms.
2. The Fourier spectrum of an image current/charge signal representing a bunch of ions with the same mass/charge ratio has harmonics that strictly decrease in amplitude with increasing harmonic order. The inventors found that the lower the rate of decrease, the better.
3. A window function that delivers the required dynamic range is applied to the acquired image charge/current signal in the time domain.

4. The acquired image charge/current signal in the time domain is then padded with zeros.
5. The Fourier transform is applied to the image charge/current signal.
6. The maximum harmonic number M is set to 15 or higher.
7. Several calibration signals are used for the calculation of the basis signals.
8. An interpolation of at least 5 data points of the Fourier spectrum is used to find the position of each peak.
9. A polynomial calibration function is used to calculate a mass/charge ratio dependent offset for the basis signals in the time domain.
10. A portion of the image charge/current signal is used for orthogonal projection. For example, the initial 25 ms of the image charge/current signal may be used for orthogonal projection.
11. Disregarding candidate fundamental frequencies that produce very small or negative coefficients and repeating Phase 2 as described under "Additional considerations" point 2, above.

Possible Modifications

The method may be modified in the following ways, depending on requirements of a particular application, for example:

1. A different peak selection and validation procedure may be used.
2. Use of different window functions in Fourier transform.
3. Using an absorption mode frequency spectrum to identify candidate fundamental frequencies. Because the absorption mode spectra usually give higher resolving power, selecting peak position in such spectra gives better accuracy to determine the candidate fundamental frequencies of bases signals. As is known in the art, an absorption mode spectra can be obtained by pre-calculating a phase-frequency relationship for different harmonic numbers (based e.g. on a set of calibration measurements), and then taking the FFT of an image charge/current signal and using the pre-calculated phase-frequency relationship to correct the phase of the complex values in the FFT spectrum before taking the real values, see e.g. References [5] and [6].
4. Use part of the acquired image charge/current signal for Fourier transform or padding the acquired image charge/current signal or a section of it with zeros.
5. Use several calibration signals.
6. The Image charge/current signal may be derived from image charge/current signals acquired by several pick-up detectors. For example, the image charge/current signal may be produced by performing a linear combination of image charge/current signals acquired from multiple detectors, as described in Reference [2].
7. Different processing and/or filtering steps may be performed on the raw image charge/current signal and the basis signals before they are used in the OPM.
8. Using more than one time interval in the time domain representation of the image charge/current signal for forming the basis signals and performing OPM, rather than using one contiguous time interval. The selected one or more time intervals may correspond to the most interesting parts of the signal. For example, if the image charge/current signal was acquired over a period of 300 ms but the time interval of 100-200 ms contained instrument interference and was therefore not reliable, the orthogonal projection method may be performed using only two segments of that image charge/current signal corresponding to the time intervals of 0-100 ms and 200-300 ms.
9. Selecting one or more sampling points from the time domain representation of the image charge/current signal that are of most interest (say, around peaks and/or where the signal to noise ratio is higher than some predetermined threshold) and use only those selected sampling points for forming the basis signals and performing OPM, rather than using sampling points having a fixed time step. In this way, it may be possible to avoid using time points where no significant events occur.
10. Disregarding candidate fundamental frequencies that produce very small or negative coefficients and repeating Phase 2 as described under "Additional considerations" point 2, above.

The advantages of the method disclosed herein are discussed below in relation to References [1]-[3] (which are discussed in the Background section).

Reference [1]:

Practical limitations of the method described in Reference [1]:

To achieve a reasonable mass accuracy the distance between the basis vectors on the mass scale must be very small. For any practically useful mass range this results in a very large number of tightly spaced basis vectors. As the present inventors found, such large sets of basis vectors not only take an unacceptably long time to process, but also result in the detection of significantly incorrect amounts for various ions even for not very complex ion compositions.

Although it is possible to reduce the processing time by utilizing more powerful computing hardware (and increasing the cost of the instrument), it is impossible to establish such a set of basis signals that would work without significant artefact peaks for all ion compositions.

What is different in the method disclosed herein:

In the method disclosed herein, when calculating basis vectors, the present inventors preferably use only the mass numbers that have been discovered as a result of deconvolution of the test signal's Fourier spectrum. The deconvolution process delivers mass numbers calculated from the highest possible harmonics, which results in higher mass accuracy and therefore there is no need in generating tightly spaced basis vectors. This, in turn, results in greatly reduced sets of basis vectors containing predominantly mass numbers of the real ions. Such sets of basis vectors not only take less time to process, but also result in greater mass accuracy and in more accurate estimates of the ion amounts even for complex ion compositions and even when the test signal contains considerable amount of noise.

Reference [2]:

Practical Limitations of the Method Described in Reference [2]:

In the method described in Reference [2], (1) at least two pickup detectors are required; (2) there is a limited mass/charge ratio range when using at least two detectors; (3) there is a limited mass accuracy and resolving power. Using several pickup detectors makes the instrument more expensive and using only the first harmonic for the calculation of mass/charge ratios results in the mass accuracy and resolving power figures that are significantly lower than those that could be obtained on the same instrument by just using the higher harmonics. The inventors found that this method could lead to an error in intensity estimates of around 20%, even for relatively large peaks.

What is Different in the Method Disclosed Herein:

In the method disclosed herein, only a single image charge/current signal from a single pickup detector is required; there are no inherent limitations on the mass/charge ratio range; the mass accuracy and the resolving power match those found at higher harmonics. The inventors found that the error associated with a mass estimated using the method disclosed herein was less than 1% of the largest peak, even for relatively complex spectra.

Reference [3]:

Practical Limitations of the Method Described in Reference [3]:

In the method described in Reference [3], (1) at least two pickup detectors required (five detectors have been used in our tests); (2) the method cannot distinguish two masses, where the frequency of one of them is an integer multiple of the frequency of the other. For example, mases $M_1$ and $M_2$, $\sqrt{M_1}=N\times\sqrt{M_2}$, where N =1, 2, 3, will not be distinguished; (3) the method has difficulty with distinguishing individual masses and their intensities in complex mass spectra. Again, using several pickup detectors makes the instrument more expensive and the inability to distinguish masses as in (1) conceals the true performance of the instrument.

What is Different in the Method Disclosed Herein:

In the method disclosed herein, only a signal from a single pickup detector is required and there are not problems (2) and (3) mentioned above. Our method also achieves both greater mass accuracy and resolving power as they are obtained using only higher order harmonics of a spectrum rather than a whole spectrum as in Reference [3].

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

REFERENCES

1. Qi Sun, Changxin Gu and Li Ding, "Multi-ion quantitative mass spectrometry by orthogonal projection method with periodic signal of electrostatic ion beam trap", J. Mass Spectrom. 2011, 46, 417-424.
2. EP2642508 A2.
3. J. B. Greenwood, O. Kelly, C. R. Calvert, M. J. Duffy, R. B. King, L. Belshaw, L. Graham, J. D. Alexander, I. D. Williams, W. A. Bryan, I. C. E. Turcu, C. M. Cacho and E. Springate. "A comb-sampling method for enhanced mass analysis in linear electrostatic ion traps", Review of Scientific Instruments, 2011, 82(4).
4. WO2012/116765
5. Yulin Qi et al, "Absorption-Mode: The Next Generation of Fourier Transform Mass Spectra", Analytical Chemistry, 2012, p2923-2929.
6. David P. A. Kilgour et al, "Producing absorption mode Fourier transform ion cyclotron resonance mass spectra with non-quadratic phase correction functions", Rapid Communications in Mass Spectrometry, 2015, p1087-1093.

The invention claimed is:

1. A method of processing an image charge/current signal representative of trapped ions undergoing oscillatory motion, the method including:

identifying a plurality of candidate fundamental frequencies potentially present in the image charge/current signal based on an analysis of peaks in a frequency spectrum corresponding to the image charge/current signal in the frequency domain, wherein each candidate fundamental frequency falls in a frequency range of interest;

deriving a basis signal for each candidate fundamental frequency using a calibration signal; and estimating relative abundances of ions corresponding to the candidate fundamental frequencies by mapping the basis signals to the image charge/current signal;

wherein, at least one candidate fundamental frequency is calculated using a frequency associated with a peak that falls outside the frequency range of interest and that has been determined as representing a second or higher order harmonic of the candidate fundamental frequency.

2. A method according to claim 1, wherein only one basis signal is derived for each candidate fundamental frequency.

3. A method according to claim 1, wherein the analysis of peaks in the frequency spectrum includes a validation procedure applied to each of multiple test peaks that fall in a validation frequency range that includes frequencies that are higher than an upper bound $F_{MAX}$ of the frequency range of interest, wherein the validation procedure that is applied to each of the multiple test peaks includes:

(i) determining whether the test peak potentially represents an Nth order harmonic of a fundamental frequency $f_t/N$ falling within the frequency range of interest, where $f_t$ is a frequency associated with the test peak and N is an integer greater than 1, this determination being based on a check of whether the frequency spectrum contains, for at least one value of P from P=1 to P=N−1 where P is an integer, a peak corresponding to a Pth order harmonic of the fundamental frequency of $f_t/N$;

(ii) if it is determined that the test peak potentially represents an Nth order harmonic of a fundamental frequency $f_t/N$ falling within the frequency range of interest, then identifying a candidate fundamental frequency in the image charge/current signal of $f_t/N$.

4. A method according to claim 3, wherein steps (i) and (ii) are performed for each possible value of N for which $f_t/N$ falls within the frequency range of interest and for which N is less than or equal to M, where M represents a predetermined maximum harmonic number.

5. A method according to claim 3, wherein the validation frequency range includes frequencies between $F_{MAX}$ and $F_{MAX}$×M, where M represents a predetermined maximum harmonic number.

6. A method according to claim 5, wherein the validation procedure is applied to the multiple test peaks that fall in the validation frequency range starting with the peak that has a corresponding frequency closest to and less than or equal to $F_{MAX}$×M and continuing with the others of the multiple test peaks in decreasing order of their associated frequencies.

7. A method according to claim 1, wherein the candidate fundamental frequency is calculated using a frequency associated with a peak in the validation frequency range that has been determined as representing the highest available order harmonic of the candidate fundamental frequency.

8. A method according to claim 1, wherein the image charge/current signal has a duration in the time domain of at least 200 ms.

9. A method according to claim 1, wherein multiple calibration signals are used to derive the basis signals, wherein the multiple calibration signals used to derive the basis signals are image charge/current signals obtained for known ion mass/charge ratios.

10. A method according to claim 1, wherein the relative abundances of ions corresponding to the candidate fundamental frequencies are estimated by mapping the basis signals to a portion of the image charge/current signal in the time domain.

11. A method according to claim 1, wherein a polynomial calibration function is used to calculate a mass/charge ratio dependent offset for the basis signals in the time domain.

12. A method according to claim 1, wherein mapping the basis signals to the image charge/current signal includes approximating the image charge/current signal using a linear combination of the basis signals to provide a best fit of the image charge/current signal.

13. A method according to claim 1, wherein the method includes:

if one or more of the estimated relative abundances meets a criterion indicating that a candidate fundamental frequency corresponding to the estimated relative abundance is absent from the image charge/current signal, forming a subset of the basis signals that excludes the one or more basis signals derived for the candidate fundamental frequencies indicated as being absent from the image charge/current signal;

estimating relative abundances of ions corresponding to the candidate fundamental frequencies by mapping the formed subset of the basis signals to the image charge/current signal.

14. A method according to claim 1, wherein the frequency spectrum corresponding to the image charge/current signal in the frequency domain is an absorption mode frequency spectrum.

15. A method according to claim 1, wherein the basis signal for each candidate fundamental frequency is derived using a time domain calibration signal, wherein the time domain calibration signal is transformed into a time domain basis signal using a time offset term which is dependent on mass/charge ratio associated with the candidate fundamental frequency.

16. A method according to claim 15, wherein the time offset term dependent on mass/charge ratio is derived using phase information obtained from a plurality of time domain calibration signals that have been transformed into the frequency domain.

17. A method according to claim 1, wherein the basis signal for each candidate fundamental frequency is derived using a time domain calibration signal, wherein the time domain calibration signal is transformed into a time domain basis signal using a time delay term which reflects a delay between the start of recording the image charge/current signal and the moment of injection of ions into an ion trap mass spectrometer.

18. A method according to claim 1, wherein the basis signal for each candidate fundamental frequency is derived using a time domain calibration signal, wherein the time domain calibration signal is transformed into a time domain basis signal using a decay term that is a function of time, mass/charge ratio, and a variable representative of the number of ions corresponding to the candidate fundamental frequency.

19. An ion trap mass spectrometer having:

an ion source configured to produce ions;

a mass analyser configured to trap the ions such that the trapped ions undergo oscillatory motion in the mass analyser;

at least one image charge/current detector for use in obtaining an image charge/current signal representative of trapped ions undergoing oscillatory motion in the mass analyser; and a processing apparatus configured to perform a method according to claim 1, wherein the apparatus includes a computer.

20. A computer-readable medium having computer-executable instructions configured to cause a computer to perform a method according to claim 1.

* * * * *